US012780269B2

(12) United States Patent
Krüger

(10) Patent No.: US 12,780,269 B2
(45) Date of Patent: Nov. 3, 2026

(54) RAIL VEHICLE AND METHOD FOR OPERATING A RAIL VEHICLE

(71) Applicant: Siemens Mobility GmbH, Munich (DE)

(72) Inventor: Axel Krüger, Wennigsen (DE)

(73) Assignee: Siemens Mobility GmbH, Munich (DE)

( * ) Notice: Subject to any disclaimer, the term of this patent is extended or adjusted under 35 U.S.C. 154(b) by 382 days.

(21) Appl. No.: 18/697,532

(22) PCT Filed: Sep. 1, 2022

(86) PCT No.: PCT/EP2022/074336

§ 371 (c)(1),
(2) Date: Apr. 1, 2024

(87) PCT Pub. No.: WO2023/052029

PCT Pub. Date: Apr. 6, 2023

(65) Prior Publication Data

US 2024/0391508 A1 Nov. 28, 2024

(30) Foreign Application Priority Data

Sep. 30, 2021 (DE) ..... 10 2021 210 998.5

(51) Int. Cl.
*B61D 23/02* (2006.01)
*B61D 23/00* (2006.01)

(52) U.S. Cl.
CPC ..... *B61D 23/025* (2013.01); *B61D 23/00* (2013.01); *B61D 23/02* (2013.01)

(58) Field of Classification Search
CPC ..... B61D 23/00; B61D 23/02; B61D 23/025
(Continued)

(56) References Cited

U.S. PATENT DOCUMENTS 6,341,563 B1 * 1/2002 Gal ..... G01S 15/04 105/433
7,178,467 B2 * 2/2007 Le Bellec ..... B61D 23/02 105/458

(Continued)

FOREIGN PATENT DOCUMENTS

AT 519948 B1 * 4/2020 ..... B61D 23/02
CN 111086536 A * 5/2020 ..... B61D 17/00

(Continued)

OTHER PUBLICATIONS

Norm DIN EN 14752 May 2015. Bahnanwendungen—Seiteneinstiegssysteme für Schienenfahrzeuge.

(Continued)

*Primary Examiner* — S. Joseph Morano
*Assistant Examiner* — James William Jones
(74) *Attorney, Agent, or Firm* — Laurence A. Greenberg; Werner H. Stemer; Ralph E. Locher

(57) ABSTRACT

A method for operating a rail vehicle that has at least one extendable and retractable sliding step which is associated with a door, includes moving the sliding step while the rail vehicle is travelling and the door is closed, specifically using at least one sensor signal from at least one sensor which is associated with the sliding step. A rail vehicle having at least one door that has an associated extendable and retractable sliding step is also provided.

11 Claims, 5 Drawing Sheets

(58) Field of Classification Search
USPC ..... 105/443, 446, 449
See application file for complete search history.

(56) References Cited

U.S. PATENT DOCUMENTS

| | | | | |
|---|---|---|---|---|
| 2007/0200313 | A1* | 8/2007 | Tazreiter | B61D 23/025 280/166 |
| 2008/0250966 | A1* | 10/2008 | Hirtenlehner | B61D 23/02 105/445 |
| 2008/0276832 | A1* | 11/2008 | Chisena | B61D 23/025 105/458 |
| 2010/0282119 | A1 | 11/2010 | Chisnena | |
| 2012/0188346 | A1 | 7/2012 | Schnabl | |
| 2020/0283039 | A1* | 9/2020 | Bienek | B61L 15/0058 |

FOREIGN PATENT DOCUMENTS

| | | | | |
|---|---|---|---|---|
| DE | 1059493 | B | 6/1959 | |
| DE | 3708498 | A1 | 9/1988 | |
| DE | 102008061852 | A1 * | 6/2010 | B61D 23/025 |
| DE | 102009039162 | A1 * | 3/2011 | B61D 19/026 |
| DE | 102016207263 | B3 * | 9/2017 | B61D 19/02 |
| EP | 2078656 | A1 * | 7/2009 | E05F 15/40 |
| FR | 3071801 | A1 * | 4/2019 | B61D 23/025 |
| WO | WO 9858148 | A1 | 12/1998 | |
| WO | WO-2012036117 | A1 * | 3/2012 | B61D 23/025 |

OTHER PUBLICATIONS

German Office Action dated Jun. 14, 2022, issued in German Application No. DE 10 2021 210 998.5, filed Sep. 30, 2021.
ISR dated Dec. 21, 2022, issued in PCT/EP2022/074336, filed Sep. 1, 2022.

* cited by examiner

RAIL VEHICLE AND METHOD FOR OPERATING A RAIL VEHICLE

FIELD AND BACKGROUND OF THE INVENTION

The invention relates to a method for operating a rail vehicle. Modern rail vehicles today are known to be equipped with movable, that is to say extendable and retractable, sliding steps that are each associated with a door. As soon as the rail vehicle is stationary at a station and the doors are supposed to be opened, the sliding steps are extended—before the doors are actually opened—in order to span the gap that remains between the platform edge and the rail vehicle and to prevent passengers from being able to fall into the gap and injure themselves.

SUMMARY OF THE INVENTION

The invention is based on the object of specifying an improved method for operating a rail vehicle.

This object is achieved according to the invention by a method having the features described below. Advantageous embodiments of the method according to the invention are specified in the subclaims.

Accordingly, the invention provides for at least one sliding step to be moved while the rail vehicle is in motion and the door is closed, specifically using at least one sensor signal from at least one sensor.

A substantial advantage of the method according to the invention is that—in the event of a stopping action—a considerable time saving of up to 5 seconds per stopping action can be achieved if for example the sliding steps are extended, or at least start to be extended, before the vehicle has actually stopped, and therefore the sliding steps are—at least approximately—extended to their target position envisaged after the vehicle has stopped before the vehicle has actually stopped. A similar situation applies when pulling away if, immediately after the doors have closed, the rail vehicle moves off and the sliding steps are retracted while the vehicle is moving off.

It is advantageous if the sensor or at least one of the sensors is a distance sensor that determines a vehicle/platform-related distance and outputs a measured distance value as or with the sensor signal.

The vehicle/platform-related distance measured by the distance sensor(s) is preferably the distance between the door associated with the respective sliding step and the 9 platform, the distance between the car contour in the region of the respective sliding step or door and the platform or the distance between a sliding step associated with the respective door and the platform.

If distance values measured are evaluated, it is advantageously possible to reduce the risk of a collision between the sliding steps and the platform, or the platform edge thereof, by preventing the sliding steps from being extended too far at the outset or else by correcting excessive extension. For example, if the gap between the rail vehicle and the platform edge is becoming smaller—e.g. when cornering, which involves an initially large gap reducing—the sliding steps can be retracted in order to avoid a collision.

In principle, sliding-step-specific control of the sliding steps is possible on the basis of individually associated sensors. However, it is considered to be particularly advantageous if sliding step control is performed on the basis of both sliding-step-intrinsic measured distance values and sliding-step-extrinsic measured distance values.

It is considered to be advantageous for example if the rail vehicle has at least one front door and at least one rear door arranged on the same vehicle side as the front door, the front door preceding the rear door when the vehicle is in motion, the front door has an associated front distance sensor that records a front vehicle/platform-related distance and outputs a measured front distance value indicating the recorded front distance as a sensor signal, the rear door has an associated rear distance sensor that records a rear vehicle/platform-related distance and outputs a measured rear distance value indicating the recorded rear distance as a sensor signal, and the rear sliding step is controlled while the rail vehicle is in motion by also using at least the measured front distance value.

In other words, it is thus considered to be advantageous if the rail vehicle has at least one front door and one rear door, the front door preceding the rear door when the vehicle is in motion, the front door has an associated front distance sensor that records the distance between the front door and the platform, the distance between the car contour in the region of the front door and the platform or the distance 17 between a sliding step associated with the front door and the platform and outputs a measured front distance value indicating the recorded distance as a sensor signal, the rear door has an associated rear distance sensor that records the distance between the rear door and a platform, the distance between the car contour in the region of the rear door and the platform or the distance between a sliding step associated with the rear door and the platform and outputs a measured rear distance value indicating the recorded distance as a sensor signal, and the rear sliding step is controlled while the rail vehicle is in motion by also using at least the measured front distance value.

If the rail vehicle has a plurality of doors that each have an associated sliding step and that move past the platform edge in succession when the rail vehicle enters a station equipped with a platform, it is considered to be advantageous if the doors each have an associated distance sensor that records a vehicle/platform-related distance and outputs a distance-sensor-specific measured distance value indicating the recorded distance as a sensor signal, and, with the exception of the frontmost sliding step in the direction of travel, the subsequent sliding steps are each controlled using the distance-sensor-specific measured distance value from one, multiple or all distance sensors associated with a preceding door (a door that precedes the door of the respective sliding step).

In other words, it is thus considered to be advantageous if the doors each have an associated distance sensor that records the distance between the respective associated door and the platform, the distance between the car contour in the 11 region of the associated door and the platform or the distance between a sliding step associated with the respective door and the platform and outputs a measured distance value indicating the recorded distance as a sensor signal, and, with the exception of the frontmost sliding step in the direction of travel, the subsequent sliding steps are each controlled using the measured distance value from one, multiple or all distance sensors associated with a door that precedes the door of the respective sliding step.

In view of sliding step control, it is moreover considered to be advantageous if, with the exception of the frontmost sliding step in the direction of travel, the subsequent sliding steps are each controlled using an estimated vehicle/platform-related distance value determined by estimating the actual distance at a forecast stopping place of the respective door, specifically using one, multiple or all measured distance values that have actually been measured for the forecast stopping place by those distance sensors that are associated with a door that precedes the door of the respective sliding step.

In addition, it is considered to be advantageous if the sensor signal from the at least one sensor or at least one of the sensors indicates two or more vehicle/platform-related distances, one of which relates to the current track point of the associated door and at least one other of which relates to a track point that is ahead in the direction of travel. In other words, it is thus considered to be advantageous if the measurement range of the sensor(s) also extends forward in the direction of travel; such an embodiment reduces the risk of a collision between an extended sliding step and the platform edge, because an impending gap reduction can result in the affected sliding step being retracted again in good time if necessary.

It is considered to be particularly advantageous if the sensor signal from the at least one sensor or at least one of the sensors captures a scan area that indicates a multiplicity of vehicle/platform-related distances, one of which relates to the current track point of the associated door and two or more of which relate to a track point that is ahead in the direction of travel.

In view of minimizing the risk of collision between the sliding step and the platform, it is considered to be particularly advantageous if the sensor signal from the at 19 least one sensor or at least one of the sensors indicates a multiplicity of vehicle/platform-related distances, at least one of which relates to a track point that is between 5 and 15 meters ahead in the direction of travel.

In the case of a sensor, or a distance sensor, with a measurement range oriented forward in the direction of travel, sliding-step-specific control can be performed solely on the basis of the measured distance values from the individually associated sensor; however, it is particularly advantageous if cross-sliding-step and -sensor control is performed, that is to say control that takes account not only of the measured distance values from the intrinsic sensor but also of measured distance values from one or more preceding sensors, as has been explained above.

As already addressed at the outset, the sliding steps can advantageously also be moved when the vehicle is moving off, thereby avoiding a time delay as a result of waiting until the sliding steps are retracted after the doors have closed.

To reduce the risk of a collision between the sliding step and the platform when the vehicle is moving off, it is considered to be advantageous if the sliding step is retracted while the rail vehicle is moving off and the door is closed, specifically using at least one sensor signal from at least one sensor that monitors the retraction movement of the sliding step, and the moving-off of the rail vehicle is interrupted and the rail vehicle is stopped if the sensor signal from the at least one sensor indicates a disruption to the retraction movement.

The distance sensors are preferably infrared sensors, ultrasonic sensors or laser sensors.

The invention moreover relates to a rail vehicle having at least one door that has an associated extendable and retractable sliding step. According to the invention, there is provision for the rail vehicle to be designed such that the sliding step is moved, or at least can be moved, while the rail vehicle is in motion and the door is closed, specifically using at least one sensor signal from at least one sensor.

It is particularly advantageous if the rail vehicle is designed such that it is operated, or at least can be operated, using a method as described above or in the patent claims.

It is advantageous if the sliding steps each have an associated sliding step drive controlled by an individually associated sliding step control device.

The sliding step control devices process preferably measured distance values from a distance sensor associated with the respective sliding step and, in addition, preferably measured distance values from one or more other distance sensors, which are associated with preceding sliding steps.

The sliding step control devices preferably each comprise a computing device and a memory that stores sliding step control software. The sliding step control software is preferably designed such that the computer operates as a sliding step control device as has been described above when it executes the sliding step control software.

Alternatively or additionally, there may advantageously be provision for a central control device to be present.

In the latter variant, it is advantageous if the measured distance values from two or more, preferably all, distance sensors are transferred to the central control device.

The central control device preferably evaluates the measured distance values and generates sliding-step-specific control signals. The sliding-step-specific control signals are preferably transferred to the sliding step control devices, which retract or extend the sliding steps according to the individual specifications of the central control device.

Alternatively, the central control device can also use the control signals to transfer a respective individual sliding step extension length, which is then set by the sliding step control devices independently.

It is advantageous if the central control device is designed such that it forecasts the sliding-step-specific stopping place for each of the sliding steps—while the vehicle is still in motion. The sliding-step-specific forecast of the stopping places is preferably provided taking account of a velocity value that indicates the velocity of the rail vehicle, the respective braking behavior during the stopping action and/or a planned stopping behavior stored in a vehicle control unit of the rail vehicle.

It is also advantageous if the central control device—while the vehicle is still in motion—evaluates, for each of the subsequent sliding steps—with the exception of the frontmost, that is to say first, sliding step in the direction of travel—one, multiple or all measured distance values that have actually been measured for the respective sliding-step-specifically forecast stopping place by preceding distance sensors.

The evaluation of the measured distance values that have actually been measured for the respective sliding-step-specifically forecast stopping place by the preceding 14 distance sensors preferably comprises determining a sliding-step-specific target extension length (extended position of the sliding step).

The central control device preferably generates sliding-step-specific control signals to control the sliding steps such that they each attain their sliding-step-specific target extension length, preferably before the rail vehicle has actually stopped.

The central control device preferably comprises a computing device and a memory that stores software. The latter software is preferably designed such that the computer operates as a central control device as has been described above when it executes the software.

The central control device may advantageously be implemented in a vehicle control unit of the rail vehicle, for example in the form of the latter software.

The invention is explained in more detail below on the basis of exemplary embodiments.

DETAILED DESCRIPTION OF THE INVENTION

The same reference signs are used for identical or comparable components throughout the figures for the sake of clarity.

Figure 1:
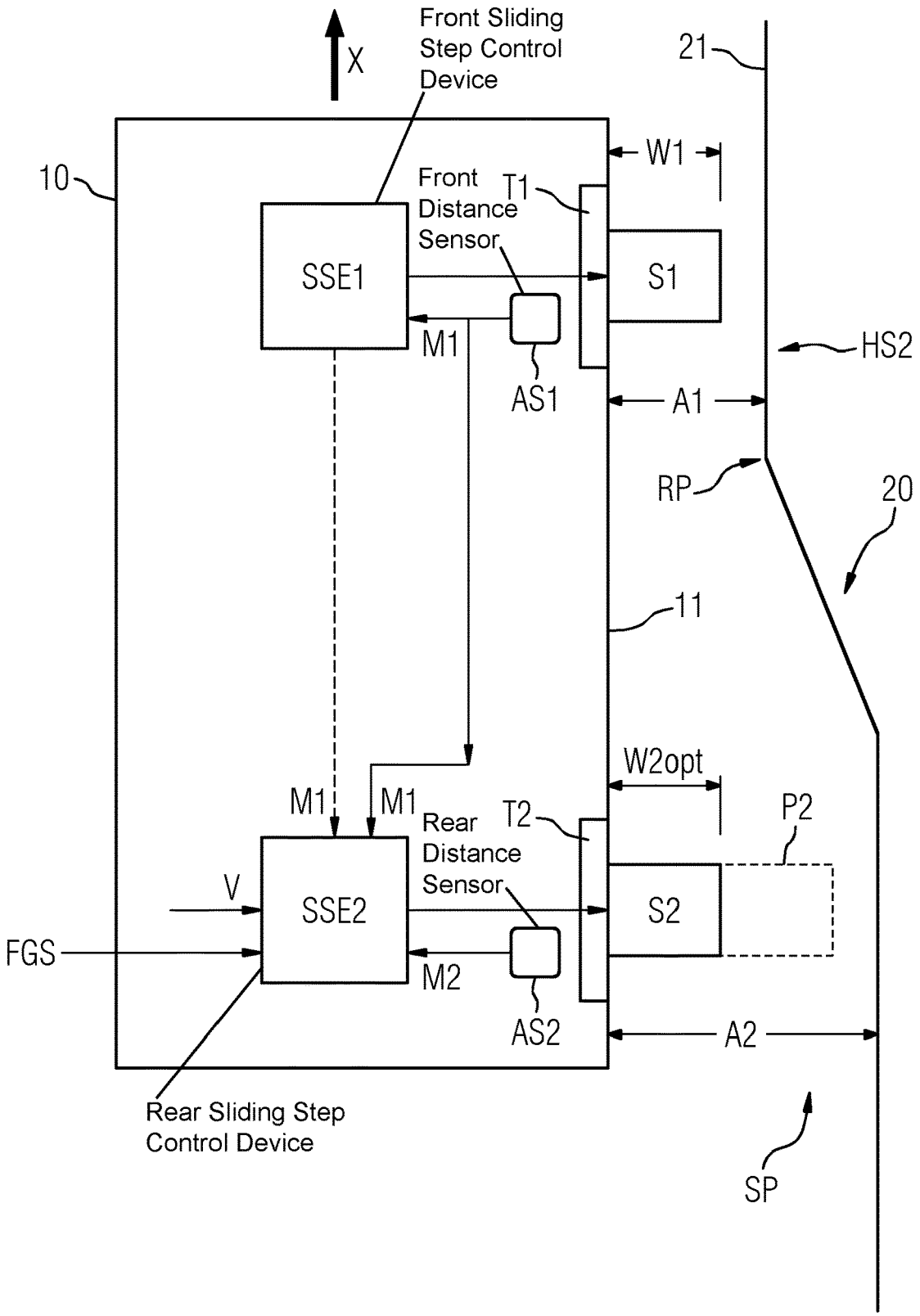
FIG. 1 shows a schematic representation of a first exemplary embodiment of a rail vehicle according to the invention, which is used by way of illustration to explain a first exemplary embodiment of a method according to the invention.

FIG. 1 shows a first exemplary embodiment of a rail vehicle 10 according to the invention, which is used by way of illustration to explain a first exemplary embodiment of a method according to the invention.

The rail vehicle 10 in the illustrative representation shown in FIG. 1 travels along the track coordinate or location coordinate X, which thus corresponds to the direction of travel of the rail vehicle.

A front door, denoted by the reference sign T1, is located on a vehicle side 11, which faces a platform edge 21 at a station 20, not shown in more detail, in the direction of travel X. On the same vehicle side 11 there is a rear door T2, which succeeds the front door T1 in the direction of travel X.

The front door T1 is equipped with a front sliding step S1 that can decrease the gap SP between the car skin of the rail vehicle 10 in the region of the front door T1 and the platform 6 edge 21, in order—when the rail vehicle 10 is stationary and the front door T1 is open—to prevent persons from slipping or falling into the gap SP. The front sliding step S1 can be extended, that is to say moved in the direction of the platform edge, and also retracted again using a sliding step drive, which is not shown in FIG. 1 for reasons of clarity.

The sliding step drive of the front sliding step S1 is controlled by an associated sliding step control device SSE1 that, in the representation shown in FIG. 1, evaluates the sensor signal from a front distance sensor AS1 and selects the extended span W1 of the front sliding step S1 such that the distance thereof from the platform edge 21 is in a predefined target range.

The front distance sensor AS1 records a vehicle/platform-related distance A1, for example the distance between the front door T1 and the platform edge 21, the distance between the car contour in the region of the front door T1 and the platform edge 21 or the distance between the sliding step S1 associated with the front door T1 and the platform edge 21, and outputs a measured front distance value M1 indicating the recorded distance A1 as or using a sensor signal.

The rear door T2 is equipped with a rear sliding step S2 that can decrease the gap SP between the car skin of the rail vehicle 10 in the region of the rear door T2 and the platform edge 21, in order—when the rail vehicle 10 is stationary and the rear door T2 is open—to prevent persons from slipping or falling into the gap SP in the region of the rear door T2. The rear sliding step S2 can be extended or retracted using a rear sliding step drive, which is not shown in FIG. 1 for reasons of clarity.

A rear distance sensor AS2 records a rear vehicle/platform-related distance A2, for example the distance between the rear door T2 and the platform edge 21, the distance between the car contour in the region of the rear door T2 and the platform edge 21 or the distance between the sliding step 32 associated with the rear door T2 and the platform edge 21, and outputs a measured rear distance value M2 indicating the recorded distance A2 as or using a sensor signal.

The sliding step drive of the rear sliding step S2 is controlled by an associated rear sliding step control device SSE2. The rear sliding step control device SSE2—analogously to the front sliding step control device SSE1—is connected to the rear distance sensor AS2 associated with the rear door T2 and can therefore evaluate the measured rear distance value M2.

Additionally, the rear sliding step control device SSE2 is connected—directly as shown by a solid line in FIG. 1 and/or indirectly via the front sliding step control device SSE1 as shown by a dashed line in FIG. 1—to the front distance sensor AS1 and can therefore also process the measured front distance value M1.

For the remainder of the explanations, it is assumed by way of illustration that the platform edge 21 is not exactly straight, and so the distance between the platform edge and the vehicle skin varies. The shape shown in FIG. 1 is intended to be understood only schematically; most variances between the platform edge 21 and the vehicle skin are normally based on tolerances in curved track sections and accordingly in the region of curved platform edges.

In addition, the remainder of the explanations relate by way of illustration to the case in which the rail vehicle 10 is in the process of stopping or is slowing, but the place marked by the reference sign RP in FIG. 1 will still be passed by the second door 12 before the vehicle is finally at a standstill.

If the rear sliding step control device SSE2 now starts to extend the rear sliding step S2—for example in response to an applicable enable signal FS from a superordinate vehicle controller, not shown—before the vehicle is finally at a standstill, it could extend the rear sliding step S2 to the position P2, marked by the dashed line, which projects right up to the platform edge; this would be entirely possible in view of the measured rear distance value M2. Instead, however, it is advantageous if the rear sliding step control device SSE2 also takes account of the measured front distance value M1 and extends the rear sliding step S2 only as far as the measured front distance value M1 suggests is sensible. In the situation shown in FIG. 1, it can be seen that it would not be expedient to extend the rear sliding step S2 a long way, because the characteristic of the measured front 21 distance value M1 indicates that the gap between the rail vehicle 10 and the platform edge 21 will reduce again when the vehicle moves on, and the rear sliding step S2 would need to be retracted again. Accordingly, the rear sliding step control device SSE2 will preferably not extend the rear sliding step S2 further than is prescribed by the measured front distance value M1.

It is advantageous if the rear sliding step control device SSE2 makes a forecast—for example on the basis of a velocity value V that indicates the velocity of the rail vehicle 10, the braking behavior during the stopping action and/or a planned stopping behavior stored in a vehicle control unit of the rail vehicle 10—and determines a forecast stopping place HS2 at which the rear door 12 of the rail vehicle 10 will probably halt.

The temporal and thus local characteristic delivered for the measured front distance value M1 by the front distance sensor AS1 and the measured front distance value M1 at the forecast stopping place HS2 can be used by the rear sliding step control device SSE2 to determine a vehicle/platform-related target distance value and a corresponding optimum extended span W2*opt* for the rear sliding step S2 and this forecast stopping place HS2. Moreover, it can extend the rear sliding 8 step S2—taking account of the local characteristic of the measured front distance value M1—such that it is extended to the applicable optimum extended span W2*opt* before the forecast stopping place HS2 is reached, without colliding with the platform edge 21.

Figure 2:
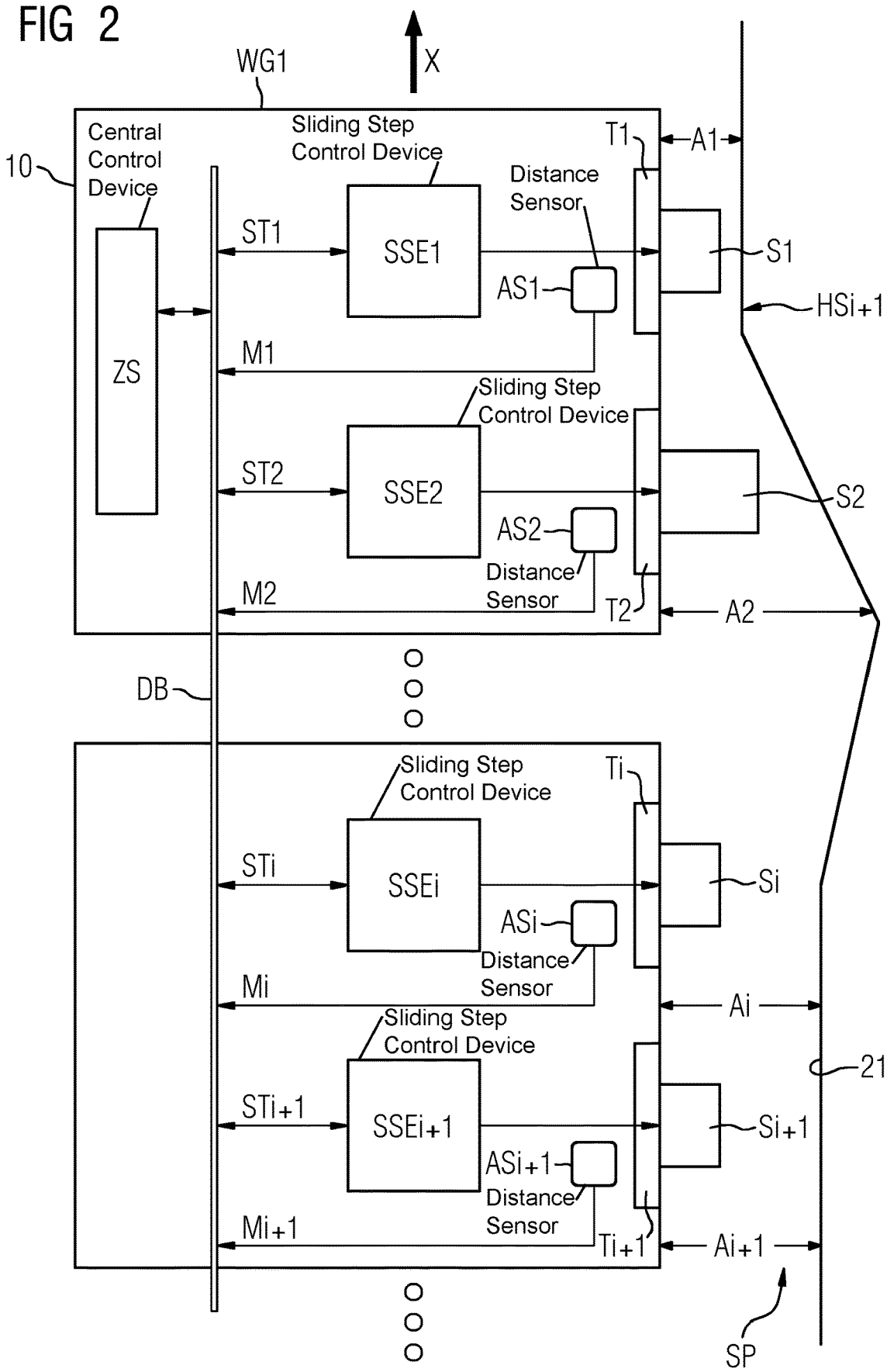
FIG. 2 shows a schematic representation of a second exemplary embodiment of a rail vehicle according to the invention, which is used by way of illustration to explain a second exemplary embodiment of a method according to the invention.

FIG. 2 shows a second exemplary embodiment of a rail vehicle according to the invention, which is used by way of illustration to explain a second exemplary embodiment of a method according to the invention.

The rail vehicle 10 shown in FIG. 2 has multiple sections and has a plurality of cars coupled to one another, of which only the first car W1 and a middle car are depicted in the figure.

The rail vehicle 10 is equipped with a number n (n is a natural number) of doors that each have an associated sliding step. FIG. 2 provides a more detailed depiction of the first sliding step S1, which is associated with the first door T1 in the direction of travel X, the second sliding step S2, which is associated with the second door T2, the i-th (i<n, i is a natural number) sliding step Si, which is associated with the i-th Ti, and the (i+1)-th sliding step Si+1, which is associated with the (i+1)-th door Ti+1.

The function of each of the sliding steps S1, S2, Si, Si+1 is to decrease the gap SP between the car skin of the rail vehicle 10 in the region of the respective door T1, T2, Ti, Ti+1 and the platform edge 21, in order—when the rail vehicle 10 is stationary and the door is open—to prevent persons from slipping or falling into the gap SP.

The sliding steps S1, S2, Si, Si+1 are each extended, that is to say moved in the direction of the platform edge 21, and also retracted again using a sliding step drive, which is not shown in FIG. 2 for reasons of clarity. The sliding step drives, not shown, of the sliding steps S1, S2, Si, Si+1 are in turn each controlled by an associated sliding step control device SSE1, SSE2, SSEi, SSEi+1.

The doors each have an associated distance sensor AS1, AS2, ASi, 11 ASi+1. The distance sensors each record a vehicle/platform-related distance A1, A2, Ai, Ai+1, for example the distance between the respective door and the platform edge 21, the distance between the car contour in the region of the respective door and the platform edge 21 or the distance between the sliding step associated with the respective door T1 and the platform edge 21, and each output a measured distance value M1, M2, Mi, Mi+1 indicating the recorded distance as or using a sensor signal and transmit said measured distance value to a central control device ZS via a data distribution device, which may be an on-vehicle data bus DB, for example.

The data bus DB also connects the sliding step control devices SSE1, SSE2, SSEi, SSEi+1 to the central control device ZS, and so the latter can individually control the sliding step control devices using control signals ST1, ST2, STi, STi+1.

The control signals ST1, ST2, STi, STi+1 can merely call for or trigger extension or retraction of the respective sliding step; alternatively, the control signals can also be used to transfer an individual sliding step extension length, which the sliding step control devices set independently.

It is advantageous if the central control device ZS is designed such that—while the vehicle is still in motion—it forecasts the sliding-step-specific stopping place (stopping point) for each of the sliding steps S1, Si, Si+1. The sliding-step-specific forecast of the stopping places is preferably provided taking account of a velocity value V that indicates the velocity of the rail vehicle 10, the respective braking behavior during the stopping action and/or a planned stopping behavior stored in a vehicle control unit of the rail vehicle 10.

The central control device ZS can then—while the vehicle is still in motion—evaluate, for each of the subsequent sliding steps S2, Si, Si+1—with the exception of the frontmost, that is to say first, sliding step S1 in the direction of travel—one, multiple or all measured distance values that have actually been measured for the sliding-step-specifically forecast stopping places by preceding distance sensors.

For example, the distances A1, A2 to A1 or the corresponding measured distance values M1 to Mi from the preceding distance sensors AS1-ASi can be evaluated for the (i+1)-th sliding step Si+1 in order to estimate what vehicle/platform-related distance Ai+1 the rail vehicle 10 will have in the region of its (i+1)-th sliding step Si+1 at the forecast stopping place HSi+1 thereof.

This sliding-step- or door-specifically estimated vehicle/platform-related distance Ai+1 can be calculated for example by averaging the measured distance values M1 to Mi from the measured distance values M1 to Mi measured for the forecast stopping place HSi+1.

Figure 3:
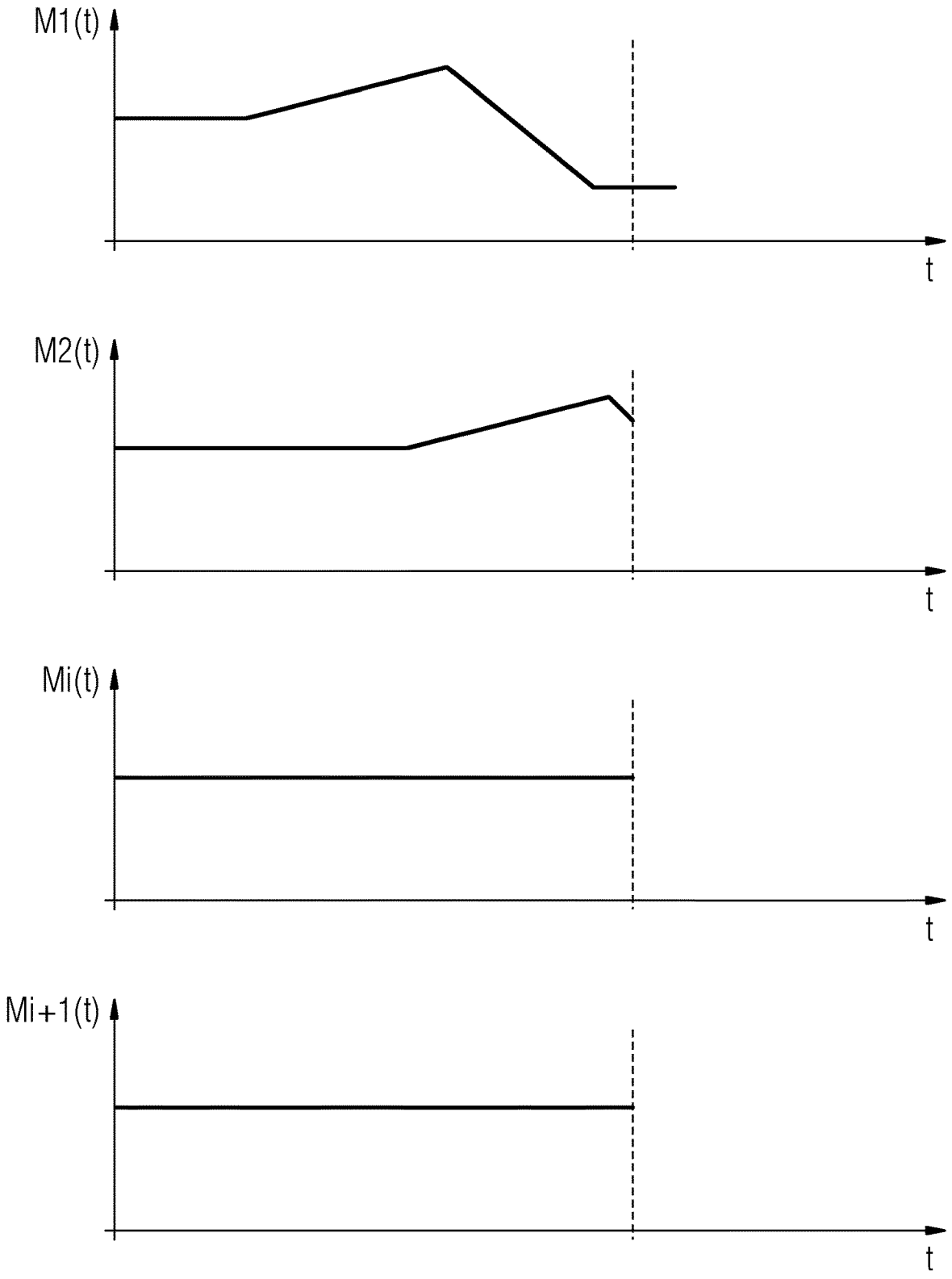
FIG. 3 shows exemplary measurement curves for the distance sensors over time in the case of the second exemplary embodiment shown in FIG. 2, and FIG. 4-5 show schematic representations of further exemplary embodiments of rail vehicles according to the invention, which are used by way of illustration to explain further exemplary embodiments of methods according to the invention.

By evaluating the measured value characteristics of the measured distance values M1, M2, Mi and Mi+1 (see FIG. 3) over time t and thus indirectly also over the track coordinate or location coordinate X, it is also possible to prevent the sliding steps from being extended too far while the vehicle is in motion and then needing to be retracted again. As such, for example FIGS. 2 and 3 reveal that the central control device ZS can use the measured value M1 to avoid extending the i-th and (i+1)-th sliding step beyond the position depicted in FIG. 2, because these sliding steps would otherwise need to be retracted again as the vehicle moves on.

If it is assumed for example that the (i+1)-th sliding step Si+1 or the (i+1)-th door Ti+1 will stop or is meant to stop at the stopping place marked by the reference sign HSi+1 in FIG. 2, the central control device ZS is furthermore already able, at the instant shown in FIG. 2 or in the position of the rail vehicle shown in FIG. 2, to start to use the measured value characteristic of the measured value M1 to set the optimum position for the (i+1)-th sliding step, because the vehicle/platform-related distance is known at this juncture from the measured value characteristic of the measured value M(A1).

In other words, the (i+1)-th sliding step Si+1 can thus be controlled predictively by including those measured distance values that have been recorded by the distance sensors AS1 to ASi ahead and—measurement errors or measurement tolerances aside—correspond to those that the distance sensor ASi+1 will measure at later times.

Figure 4:
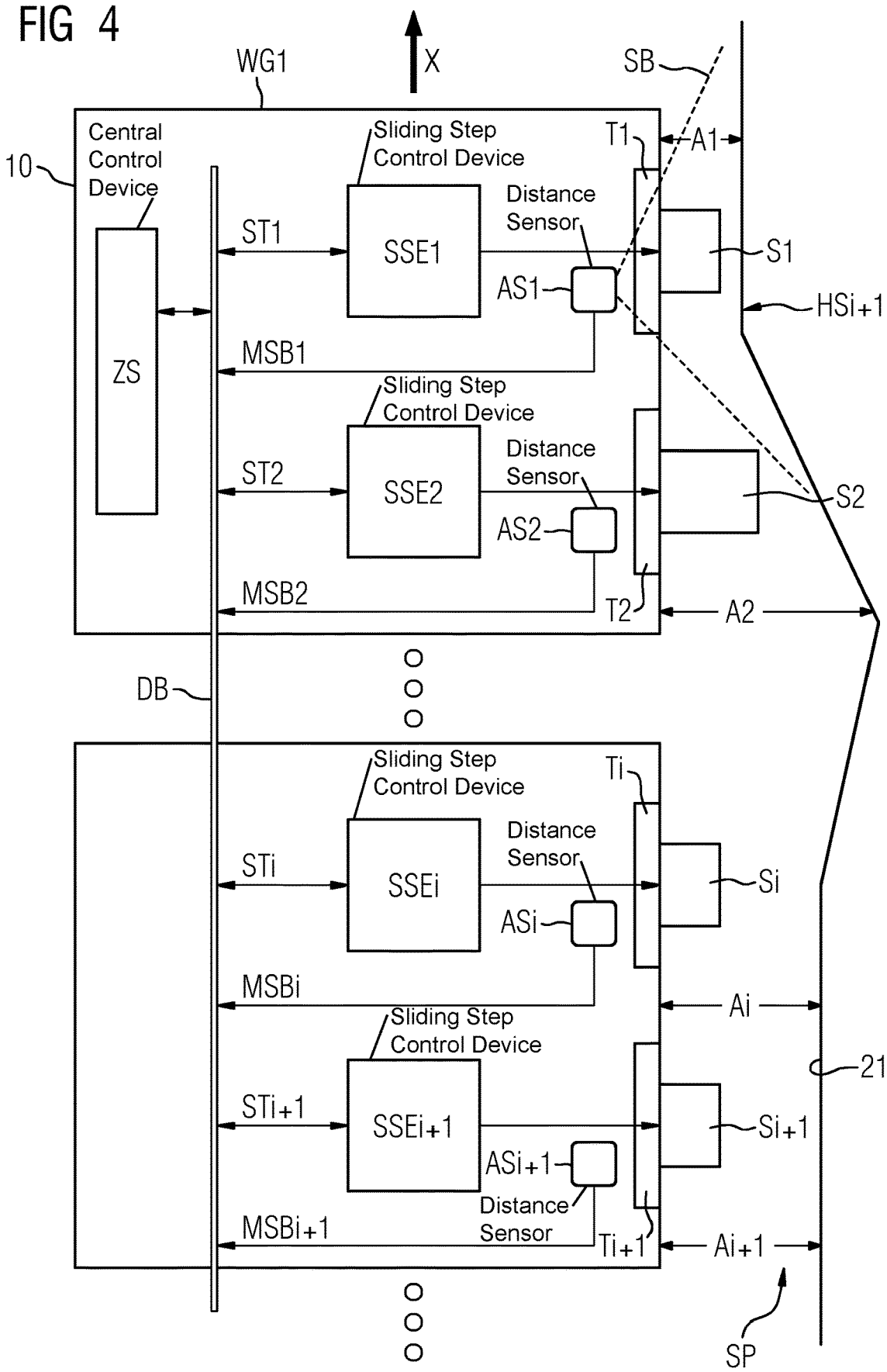

FIG. 4 shows a third exemplary embodiment of a rail vehicle 10 according to the invention, which is used by way of illustration to explain a third exemplary embodiment of a method according to the invention.

In the third exemplary embodiment, the distance sensors AS1, AS2, ASi, ASi+1 are designed such that they each cover a scan area SB, which is indicated by way of illustration for the distance sensor AS1 by dashed lines in FIG. 4.

Based on their scan area SB, the distance sensors each record a multiplicity of vehicle/platform-related distances and output scan-related sensor signals MSB1, MSB2, MSBi and MSBi+1, be it to the central control device ZS (as shown in FIG. 4) and/or to the sliding step control devices SSE1, SSE2, SSEi and SSEi+1 of the associated sliding step.

One of the recorded vehicle/platform-related distances in each of the scan-related sensor signals relates to the respective track point currently being travelled over by the associated door. Two or more vehicle/platform-related distances, preferably half of the remaining recorded vehicle/platform-related distances, in each scan-related sensor signal relate to track points that are ahead in the direction of travel.

The range of the scan areas SB is preferably so great that the distance sensors can look forward at least 5 to 15 meters in the direction of travel X and can record at least one vehicle/platform-related distance that, in terms of the respective track point of the respective distance sensor, is between 5 and 15 meters ahead in the direction of travel X.

Owing to the fact that the distance sensors in the exemplary embodiment shown in FIG. 4 also record measured distance values for track points ahead, it is certainly possible to refrain from using measured distance values from other distance sensors ahead in the direction of travel, and the sliding step control devices SSE1, SSE2, SSEi and SSEi+1 can each operate completely independently; however, it is considered to be advantageous if measured distance values—if available—from distance sensors that are ahead in the direction of travel are additionally used, as has been explained above with reference to FIGS. 1 to 3. For example, measured distance values relating to track points ahead can be averaged—in terms of track points, that is to say in terms of the respective corresponding track points—with measured distance values from other preceding distance sensors, in order to minimize measurement tolerances.

By way of example, such averaging can be carried out by the central control device ZS if the scan-related sensor signals MSB1, MSB2, MSBi and MSBi+1 from the distance sensors are transferred thereto. In this regard, the above explanations in regard to FIGS. 1 to 3 apply accordingly.

Figure 5:
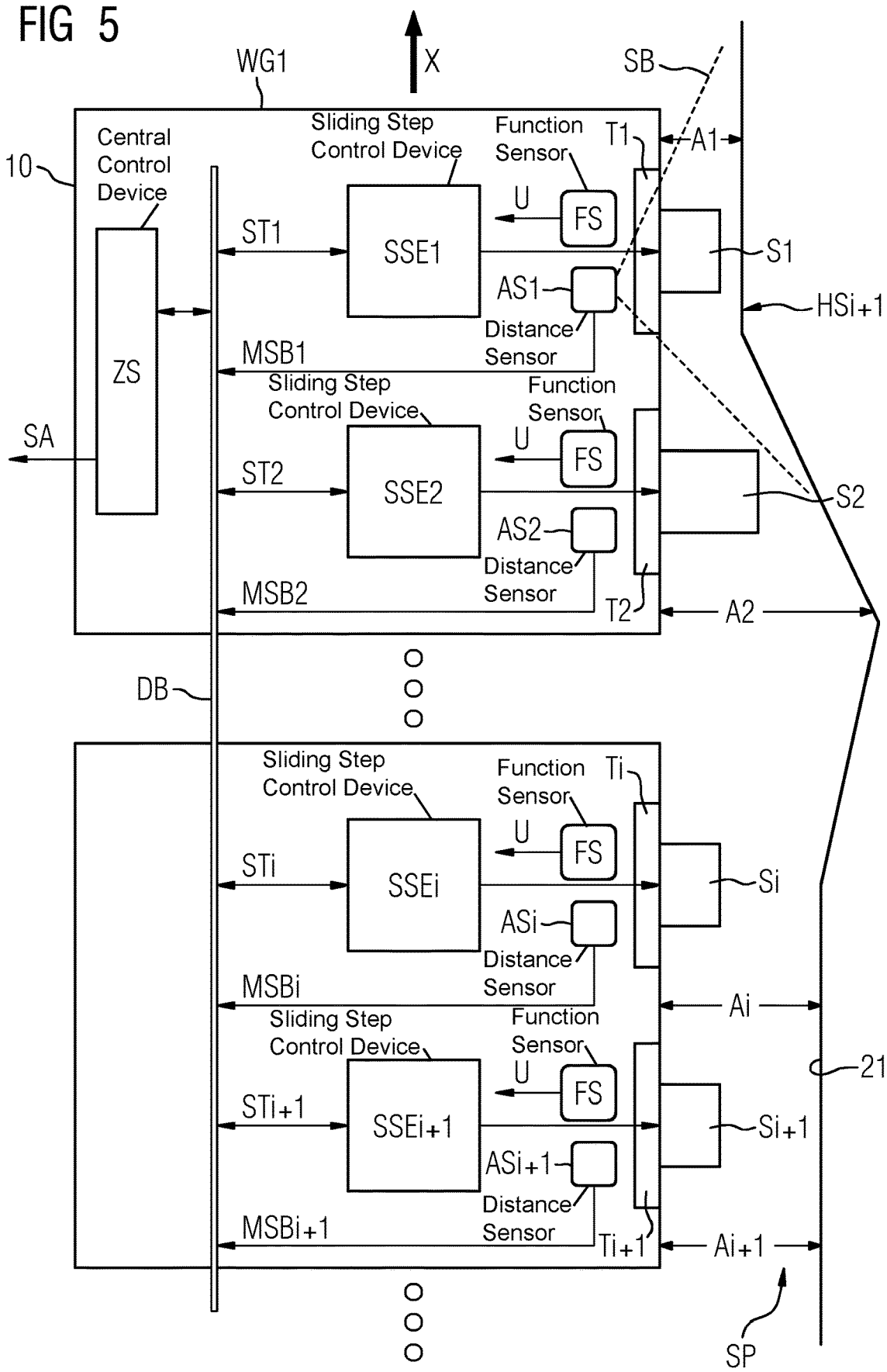

FIG. 5 shows a fourth exemplary embodiment of a rail vehicle 10 according to the invention, which is used by way of illustration to explain a fourth exemplary embodiment of a method according to the invention.

In the case of the rail vehicle 10 shown in FIG. 5, each of the sliding steps S1, S2, Si, Si+1 has an associated function sensor FS that monitors the movement of the respective sliding step and transfers an appropriate monitoring signal U to the central control device ZS.

If the sliding steps are not retracted until the rail vehicle 10 is moving off and if the central control device ZS detects a disruption to the retraction movement for at least one of the sliding steps S1, S2, Si, Si+1 on the basis of the monitoring signals U, it generates an alarm signal SA. If the alarm signal SA is present, the moving-off of the rail vehicle 10 is interrupted and the rail vehicle 10 is stopped.

Otherwise, the above explanations in regard to FIGS. 1 to 4 apply accordingly.

Although the invention has been illustrated and described more thoroughly in detail by way of preferred exemplary embodiments, the invention is not restricted by the examples disclosed and other variations can be derived therefrom by a person skilled in the art without departing from the scope of protection of the invention.

The invention claimed is:

1. A method for operating a rail vehicle, the method comprising:

providing a rail vehicle having at least one front door, and at least one rear door disposed on a same vehicle side as the at least one front door, the at least one front door preceding the at least one rear door when the vehicle is in motion;

using a front distance sensor associated with the at least one front door to record a front vehicle/platform-related distance and output a measured front distance value indicating the recorded front vehicle/platform-related distance as a sensor signal;

using a rear distance sensor associated with the at least one rear door to record a rear vehicle/platform-related distance and output a measured rear distance value indicating the recorded rear vehicle/platform-related distance as a sensor signal;

providing sliding steps each being associated with a respective one of the doors and each being extendable and retractable;

moving at least one of the sliding steps while the rail vehicle is in motion and the doors are closed, by using at least one of the sensor signals at least one of the front or rear distance sensors associated with at least one of the sliding steps; and controlling the sliding step associated with the at least one rear door while the rail vehicle is in motion by also using at least the measured front distance value.

2. The method according to claim 1, which further comprises:

providing the at least one front door and the at least one rear door as a plurality of doors each being associated with a respective one of the sliding steps moving past a platform edge in succession when the rail vehicle enters a station equipped with a platform;

using the distance sensor associated with each of the plurality of doors to record the vehicle/platform-related distance and output a distance-sensor-specific measured distance value indicating the recorded distance as the sensor signal; and except for a frontmost one of the sliding steps in a direction of vehicle travel, controlling each subsequent sliding step by using the distance-sensor-specific measured distance value from one, multiple or all of the distance sensors associated with a preceding door.

3. The method according to claim 1, which further comprises providing the vehicle/platform-related distance that the distance sensors measure as:

a distance between the door associated with the respective sliding step and the platform, or a distance between a car contour in a region of the respective door and the platform, or a distance between the sliding step associated with the respective door and the platform.

4. The method according to claim 1, which further comprises, except for a frontmost sliding step in a direction of vehicle travel, controlling each subsequent sliding step by using an estimated vehicle/platform-related distance value determined by estimating an actual distance at a forecast stopping place of the respective door, using one, multiple or all measured distance values having actually been measured for the forecast stopping place by the distance sensors of preceding doors.

5. The method according to claim 1, which further comprises using the sensor signal from at least one of the sensors to indicate two or more vehicle/platform-related distances, one of the vehicle/platform-related distances relating to a current track point of the associated door and at least one other of the vehicle/platform-related distances relating to a track point being ahead in the direction of vehicle travel.

6. The method according to claim 1, which further comprises using the sensor signal from at least one of the sensors to capture a scan area indicating a multiplicity of vehicle/platform-related distances, one of the vehicle/platform-related distances relating to a current track point of the associated door and two or more of the vehicle/platform-related distances relating to a track point being ahead in the direction of vehicle travel.

7. The method according to claim 1, which further comprises using the sensor signal from at least one of the sensors to indicate a multiplicity of vehicle/platform-related distances, at least one of the vehicle/platform-related distances relating to a track point being between 5 and 15 meters ahead in the direction of vehicle travel.

8. The method according to claim 1, which further comprises:

retracting the sliding step while the rail vehicle is moving off and the door is closed, by using at least one sensor signal from at least one sensor monitoring a retraction movement of the sliding step; and interrupting moving-off of the rail vehicle and stopping the rail vehicle if the sensor signal from the at least one sensor indicates a disruption to the retraction movement.

9. A rail vehicle, comprising:

a plurality of distance sensors outputting sensor signals; doors;

sliding steps being extendable and retractable, said sliding steps each being associated with a respective one of said doors;

said sliding steps being movable by using the sensor signals from said distance sensors, while the rail vehicle is in motion and said doors are closed;

a central control device receiving measured distance values from two or more or all of said distance sensors;

said central control device configured to evaluate the measured distance values and generate sliding-step-specific control signals to control said sliding steps; and said central control device configured:

to forecast a sliding-step-specific stopping place for each of said sliding steps while the vehicle is still in motion, to evaluate, for each of said sliding steps, one, multiple or all of the measured distance values having actually been measured for a respective sliding-step-specifically forecast stopping place by preceding distance sensors to form a sliding-step-specific target extension length, and to generate sliding-step-specific control signals to control said sliding steps and cause said sliding steps to attain said sliding-step-specific target extension lengths.

10. The rail vehicle according to claim 9, wherein the rail vehicle is operated or at least configured to be operated by using a method for operating the rail vehicle, the method comprising:

providing the doors of the rail vehicle as at least one front door, and at least one rear door disposed on a same vehicle side as the at least one front door, the at least one front door preceding the at least one rear door when the vehicle is in motion;

using a front distance sensor of the plurality of distance sensors being associated with the at least one front door to record a front vehicle/platform-related distance and output a measured front distance value indicating the recorded front vehicle/platform-related distance as a sensor signal;

using a rear distance sensor of the plurality of distance sensors being associated with the at least one rear door to record a rear vehicle/platform-related distance and output a measured rear distance value indicating the recorded rear vehicle/platform-related distance as a sensor signal;

associating each of the sliding steps with a respective one of the doors and configuring each of the sliding steps to be extendable and retractable;

moving at least one of the sliding steps while the rail vehicle is in motion and the doors are closed, by using at least one of the sensor signals from at least one of the front or rear distance sensors associated with at least one of the sliding steps; and controlling the sliding step associated with the at least one rear door while the rail vehicle is in motion by also using at least the measured front distance value.

11. The rail vehicle according to claim 9, which further comprises:

sliding step control devices;

said sliding steps each having an associated sliding step drive controlled by an individually associated respective one of said sliding step control devices; and said sliding step control devices being configured to process the measured distance values from said distance sensors associated with said respective sliding steps in addition to measured distance values from one or more other distance sensors associated with preceding sliding steps.

* * * * *